US011826884B1

(12) United States Patent
Lindsay

(10) Patent No.: US 11,826,884 B1
(45) Date of Patent: Nov. 28, 2023

(54) VISE JAWS FOR HOLDING IRREGULAR SHAPED OBJECTS AND METHOD OF INSTALLING THEM ON PRIOR ART VISES

(71) Applicant: Steven James Lindsay, Kearney, NE (US)

(72) Inventor: Steven James Lindsay, Kearney, NE (US)

( * ) Notice: Subject to any disclaimer, the term of this patent is extended or adjusted under 35 U.S.C. 154(b) by 223 days.

(21) Appl. No.: 17/366,603

(22) Filed: Jul. 2, 2021

(51) Int. Cl.
*B25B 1/24* (2006.01)
*B25B 1/20* (2006.01)

(52) U.S. Cl.
CPC ..... *B25B 1/241* (2013.01); *B25B 1/20* (2013.01); *B25B 1/2426* (2013.01); *B25B 1/2452* (2013.01)

(58) Field of Classification Search
CPC ... B25B 1/2426; B25B 1/20; Y10T 279/1986; A47B 1/10
USPC ..... 269/258
See application file for complete search history.

(56) References Cited

U.S. PATENT DOCUMENTS 1,059,545 A * 4/1913 Kunze ..... B25B 5/163 269/258
1,256,217 A 2/1918 Fieldhouse
1,397,409 A * 11/1921 Duwelius ..... B25B 1/2415 269/280
1,405,325 A * 1/1922 Posch ..... B25B 1/2426 269/258
2,658,415 A 11/1953 Barowsky
3,077,346 A 2/1963 Assy
3,103,353 A 9/1963 Lassy
4,047,709 A 9/1977 Thyberg et al.
4,717,132 A * 1/1988 Yang ..... B25B 7/04 269/261
4,732,373 A * 3/1988 Yang ..... B25B 1/20 269/241
4,969,638 A * 11/1990 Yang ..... B25B 1/2426 269/261
5,799,933 A * 9/1998 Yang ..... B25B 1/2426 269/261
5,984,321 A * 11/1999 Gruttadauria ..... B23B 31/16275 279/123
2023/0008280 A1* 1/2023 Lindsay ..... B25B 1/241
2023/0009028 A1* 1/2023 Lindsay ..... B25B 1/2452

FOREIGN PATENT DOCUMENTS

CN 1105309 A * 7/1995
EP 2070655 A2 * 6/2009

OTHER PUBLICATIONS

Rare Antique Fractal Vise, found at: (https://www.youtube.com/watch?v=QBeOgGt_oWU&t=13s ) (Year: 2021).*
P.K. Kunze Contribution to the World (Year: 1912).*
Mantle Vise from Mantle & Co. (Year: 2023).*
Morphing Fractal Engraving Vise Jaws (Year: 2021).*

* cited by examiner

*Primary Examiner* — Mahdi H Nejad
(74) *Attorney, Agent, or Firm* — Ryan T. Grace; Advent, LLP

(57) ABSTRACT

The invention relates to vise pivotal jaws for holding irregular shaped objects and that are modular to work on various sized prior art vises. Also relates to pivotal jaws having aid to return back to a neutral center position. The design allows ease of disassembly for cleaning and reassembly.

18 Claims, 8 Drawing Sheets

VISE JAWS FOR HOLDING IRREGULAR SHAPED OBJECTS AND METHOD OF INSTALLING THEM ON PRIOR ART VISES

BACKGROUND OF THE INVENTION

Field of Invention

The present invention relates to vise jaws for holding irregular shaped objects. The invention also relates to jaws that can be utilized on more than one size of vise by being modular. The invention also relates to construction of the morphing type jaws that can be taken apart easily by the end user for cleaning and reassembly. The invention also relates to aid in returning the morphing type jaws to their neutral position after un-clamping them from irregular shaped objects. Applicant, has been a hand engraver for 46 years and has used and made many vise jaw designs. Therefore the field of the invention use for the applicant is hand engraving and jewelry making fields, however the invention can be utilized in other fields that use a vise.

Description of Related Art

The traditional engravers ball vise which has been in existence since the nineteenth century, consists of a ball base resting in a doughnut type cradle. The top half of the ball is made to spin and tilt. On top of the ball are vise jaws. Hand engravers as well as jewelers use this type of vise to hold an object they are working on. The objects that engravers and jewelers need to hold vary in shape and size greatly. Being able to clamp these objects securely for work operations to be carried out is required. Consequently, vise jaws that can hold irregular shaped objects would be most beneficent. U.S. Pat. No. 1,405,325 to Posch teaches a milling machine type vise having nesting crescent-shaped members, holding pivotal jaws that adjust to the shape of the object being held in the vise when clamped. Referring to U.S. Pat. No. 1,405,325 to Posch, FIG. 3, the nested crescent-shaped members 11, 12, 13, 15, 17 and the pivotal jaws 20, 21 are held together utilizing mating male and female dovetail shapes 22, 23, 24 as illustrated in FIG. 4 (defined as overhanging shoulders and tongue structure in U.S. Pat. No. 1,405,325) A disadvantage to these dovetails is they can break and/or bend if one is over-pivoted and then clamped when the vise is tightened. When one does break or bend, it is difficult to repair the damage, as well as to even get them apart after the damage has occurred. The vise in U.S. Pat. No. 1,405,325 to Posch is a stand alone unit. In other words the jaws are not easily transferable or moveable to fit and work on other vises.

BRIEF SUMMARY OF THE INVENTION

It is the object of this invention to provide vise jaws that can conform to irregular shaped objects, and that are modular, so the user can utilize the jaws on other prior art vises and other prior vises that are smaller. It is also an object of this invention that the design of the jaws allow ease of disassembly by users for cleaning and reassembly. It is also the object of this invention that the jaws will have biasing help to return them to their neutral position after un-clamping them from irregular shaped objects.

BRIEF DESCRIPTION OF THE SEVERAL VIEWS OF THE DRAWINGS

FIG. 6 is a view from the rear that depicts features that can not be seen as well in FIG. 5.

FIG. 8 illustrates how jaws 20 and 21 are aligned and installed onto prior art ball vise 1, in accordance with the present invention.

FIG. 13 illustrates how sub-jaw 65 and sub-jaw 66 are aligned and installed on smaller prior art ball vise 10, in accordance with the present invention.

DETAILED DESCRIPTION OF THE INVENTION

Figure 1:
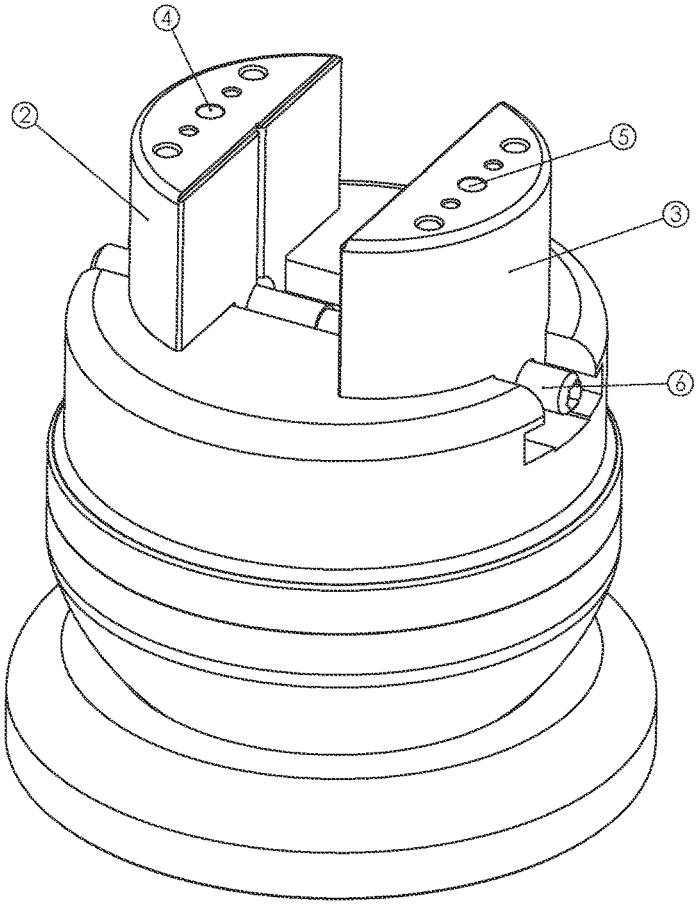
FIG. 1 PRIOR ART
FIG. 1 is an isometric view of a prior art ball vise 1.
Figure 2:
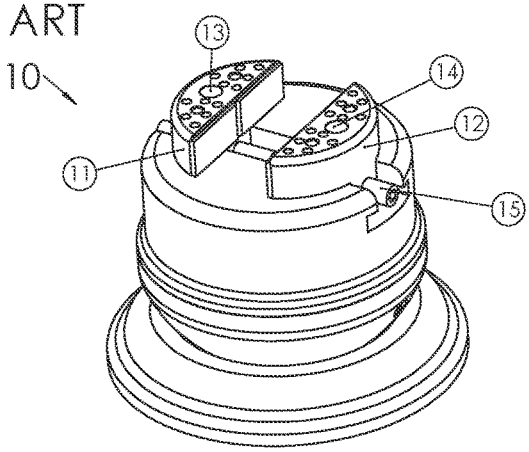
FIG. 2 PRIOR ART
FIG. 2 is an isometric view of a smaller prior art ball vise 10 that is smaller than the prior art ball vise 1 depicted in FIG. 1.

A prior art ball vise 1 is illustrated in FIG. 1. Pertinent features of prior art ball vise 1 are jaw 2, jaw 3, hole 4, hole 5 and screw 6. A user turning screw 6 will open and close jaw 2 and jaw 3 together or apart. A smaller prior art vise 10 is illustrated in FIG. 2. Pertinent features of smaller prior art ball vise 10 are jaw 11, jaw 12, hole 13, hole 14 and screw 15. A user turning screw 15 will open and close jaw 11 and jaw 12 together or apart.

Figure 3:
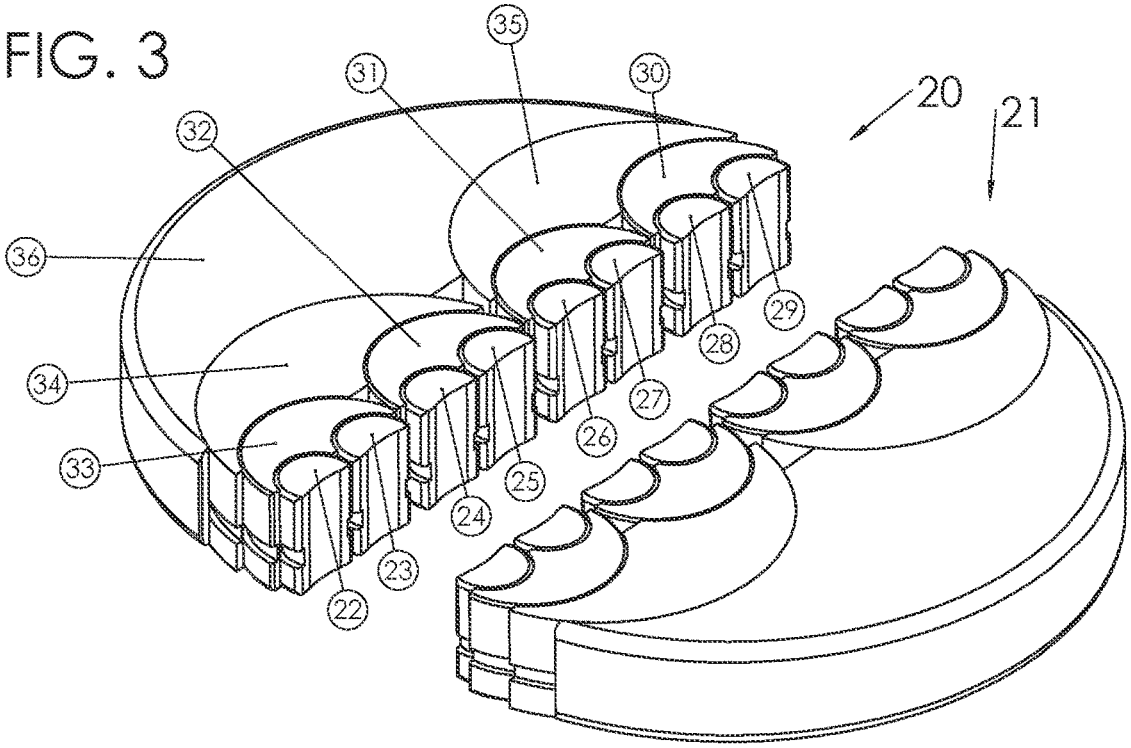
FIG. 3 is a top isometric view of a set of morphing jaws 20 and 21 in accordance with the present invention.
Figure 4:
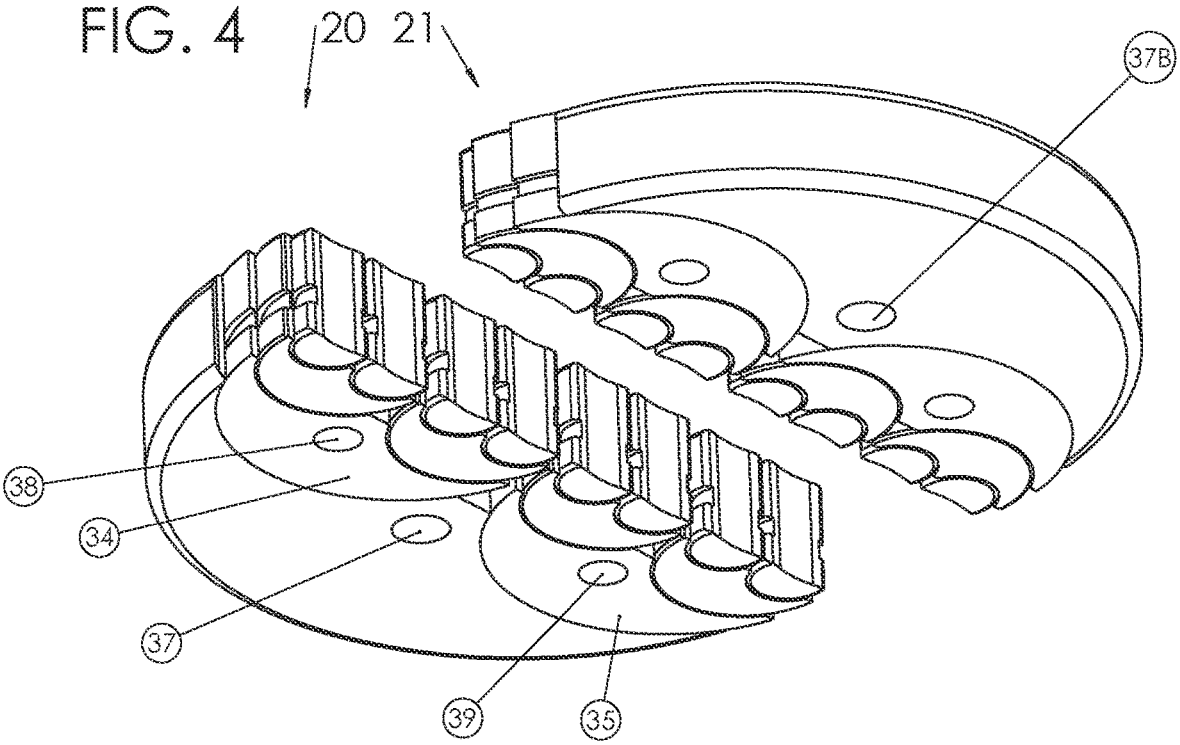
FIG. 4 is a bottom isometric view of the same set of morphing jaws 20 and 21 depicted in FIG. 3 in accordance with the present invention.
Figure 5:
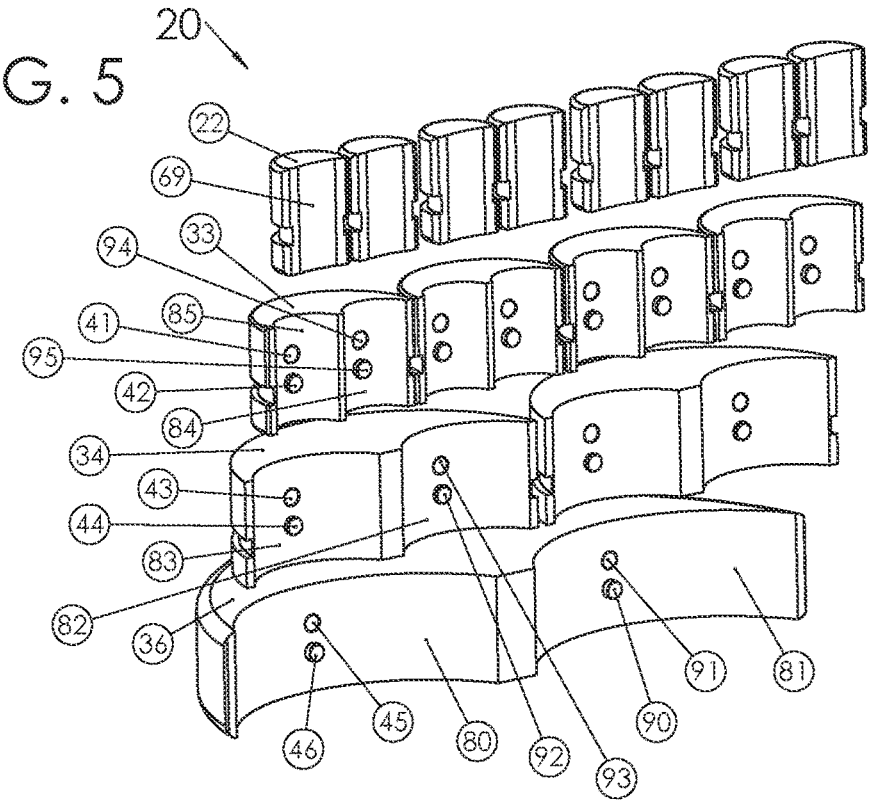
FIG. 5 is an isometric exploded front view of morphing jaw 20 depicted in FIG. 3 and FIG. 4.
Figure 6:
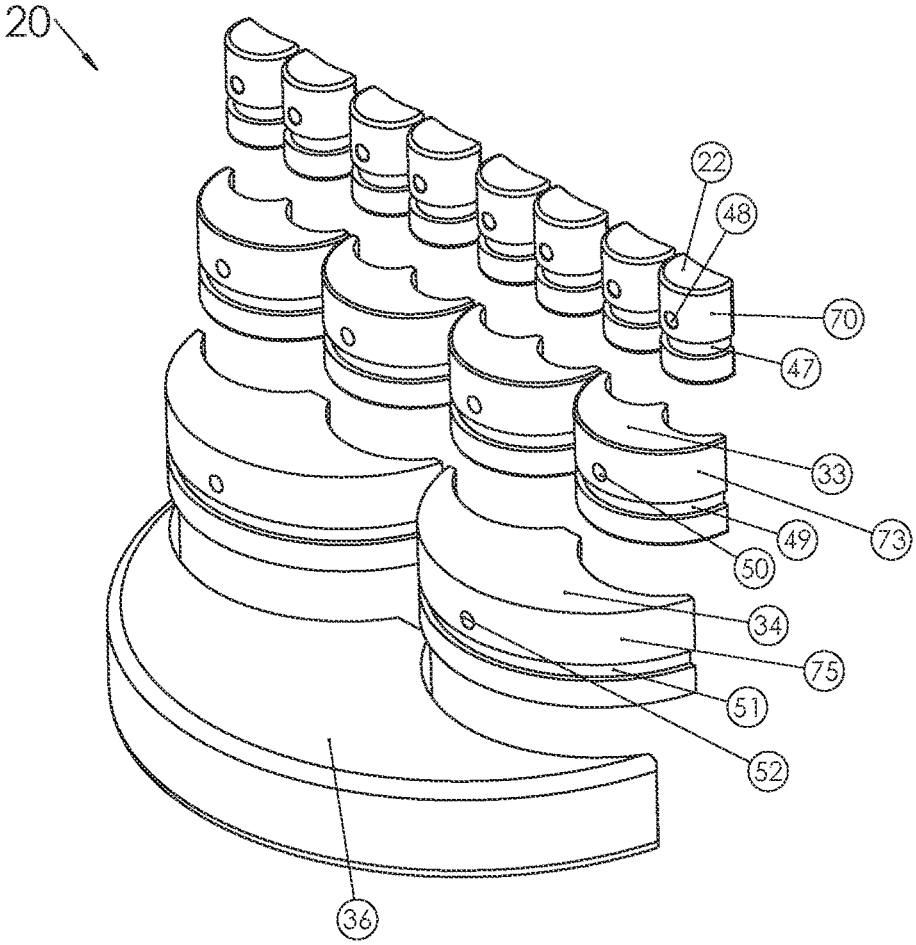
FIG. 6 is an isometric exploded rear view of morphing jaw 20 that is depicted in FIG. 5., in accordance with the present invention.

FIG. 3 and FIG. 4 depict morphing jaws 20 and 21 in accordance with the present invention. Jaws 20 and 21 are identical to each other and have the same features. FIG. 5 and FIG. 6 illustrate jaw 20 taken apart so that additional featured can be depicted. Jaw 20 consists of a series of tiers or rows of components nested together. Referring to FIG. 3, a list of nested members of jaw 20 are:

Clamping members 22, 23, 24, 25, 26, 27, 28, 29.

2nd-tier-bow-members 33, 32, 31, 30.

3rd-tier-bow-members 34, 35.

4th-tier-bow-member 36.

The first tier are clamping members, the second, third, and forth tiers are members that are bow shaped members. FIG. 3 and FIG. 4 depict the tiers in their natural center position.

In each level of tier, the members of that tier have identical features. In the following applicant will describe the first member of each tier and how they work and nest together with the first members from adjoining tiers. The remaining members of each tier fit and nest together in the same manner.

Referring to FIG. 6 and FIG. 5, features to the member of the first tier is clamping member 22. Clamping member 22 consists of a clamping surface 69, a radius-surface 70, a magnet 48, and a groove 47. Clamping surface 69 (FIG. 5) is the surface that contacts against an object that is being clamped. Magnet 48 is rigidly fastened flush or just below flush of radius-surface 70.

Referring to FIG. 3, the second tier or row that are identical to each other are 2nd-tier-bow-members 33, 32, 31, 30. Referring to FIG. 5 and FIG. 6, 2nd-tier-bow-member 33 consists of an radius-surface 73, a groove 49, a magnet 50 rigidly fastened flush or just below flush radius-surface 73, a 1st-concave-surface 85 having an inner-magnet 41 that is flush or just below the surface of 1st-concave-surface 85, a protruding-pin 42 that protrudes slightly above the surface of 1st-concave-surface 85, a 2nd-concave-surface 84 having an inner-magnet 94 that is rigidly fastened flush or just below the surface of 2nd-concave-surface 84, a protruding-pin 95 that protrudes slightly above the surface of 2nd-concave-surface 84.

Referring to FIG. 3, the third tier or row that are identical to each other are 3rd-tier-bow-members 34, 35. Referring to FIG. 5 and FIG. 6, 3rd-tier-bow-member 34 consists of an radius-surface 75, a groove 51, a magnet 52, a 1st-concave-surface 83 having an inner-magnet 43 that is flush or just below the surface of 1st-concave-surface 83, a protruding-pin 44 that protrudes slightly above the surface of 1st-concave-surface 83, a 2nd-concave-surface 82 having an inner-magnet 93 that is flush or just below the surface of 2nd-concave-surface 82, a protruding-pin 92 that protrudes slightly above the surface of 2nd-concave-surface 82. Referring to FIG. 4 that is a bottom view of the assembly illustrating that bow-shape-member 34, and bow-shape-member 35 also include dowel-pin hole 38 and dowel-pin hole 39, respectfully.

Referring to FIG. 3, the fourth tier or row consists of a single member, 4th-tier-bow-member 36. Referring to FIG. 5 and FIG. 6 4th-tier-bow-member 36 consists of a 1st-concave-surface 80 having an inner-magnet 45 that rigidly fastened flush or just below the surface of 1st-concave-surface 80, a protruding-pin 46 that protrudes slightly above the surface of 1st-concave-surface 80, a 2nd-concave-surface 81 having an inner-magnet 91 that is flush or just below the surface of 2nd-concave-surface 81, a protruding-pin 90 that protrudes slightly above the surface of 2nd-concave-surface 81. FIG. 4 is a bottom view of the assembly illustrating that bow-shape-member 36 also includes dowel-pin hole 37 and identified in jaw 21 (FIG. 4) as dowel-pin hole 37B.

Operation

The tiers or rows of nested components of morphing jaw 20 fit and interact together as follows. Referring to FIG. 5 and FIG. 6, radius-surface 70 of clamping member 22 is made to fit in 1st-concave-surface 85 of 2nd-tier-bow-members 33 with a fit that allows the two surfaces to slide. Magnet 48 that is rigidly mounted into radius-surface 70 will hold clamping member 22 within 1st-concave-surface 85 that is made of a metal having iron in it. Protruding-pin 42 fits into groove 47 with a sliding fit which keeps clamping member 22 and 2nd-tier-bow-member 33 aligned. Inner-magnet 41 is mounted in 1st-concave-surface 85 so that it's polarity will attract magnet 48 that is mounted in 1st-concave-surface 85. With the magnets mounted in this way they help realign clamping member 22 back to its neutral center position when the magnets are close enough to pull clamping member 22 back to center. It is noted that clamping member 22 can be made of a material that does or does not have iron in it and the arrangement will still work. In other words, as long one, either clamping member 22 or 1st-concave-surface 85 is made of a material that has iron it in, the two will be held together when they are turned even when their magnets are not aligned. Therefore clamping member 22 can be made of a steel with iron, or a material without iron for example a soft non marring material such as brass or plastic.

Radius-surface 73 of 2nd-tier-bow-member 33 is made to fit in 1st-concave-surface 83 of 3rd-tier-bow-member 34 with a fit that allows the two surfaces to slide. Magnet 50 that is rigidly mounted into radius-surface 73 will hold 3rd-tier-bow-member 34 within 1st-concave-surface 83 that is made of a metal having iron in it. Protruding-pin 44 fits into groove 49 with a sliding fit which keeps 2nd-tier-bow-member 33 and 3rd-tier-bow-member 34 aligned. Inner-magnet 43 has been mounted in 1st-concave-surface 83 so that its polarity will attract magnet 50 that is mounted in radius-surface 73. With the magnets mounted in this way they help realign 2nd-tier-bow-member 33 back to its neutral center position when the magnets are close enough to pull 2nd-tier-bow-member 33 back to center.

Radius-surface 75 of 3rd-tier-bow-member 34 is made to fit in 1st-concave-surface 80 of 4th-tier-bow-member 36 with a fit that allows the two surfaces to slide. Magnet 52 that is rigidly mounted into radius-surface 75 will hold 3rd-tier-bow-member 34 within 1st-concave-surface 80 that is made of a metal having iron. Protruding-pin 46 fits into groove 51 with a sliding fit which keeps 3rd-row-tier-bow-member 34 and 4th-tier-bow-member 36 aligned. Inner-magnet 45 is mounted in 1st-concave-surface 80 so that its polarity will attract magnet 52 that is mounted in radius-surface 75. With the magnets mounted in this way they help realign 3rd-tier-bow-member 34 back to its neutral center position when the magnets are close enough to pull 3rd-tier-bow-member 34 back to center.

Figure 7:
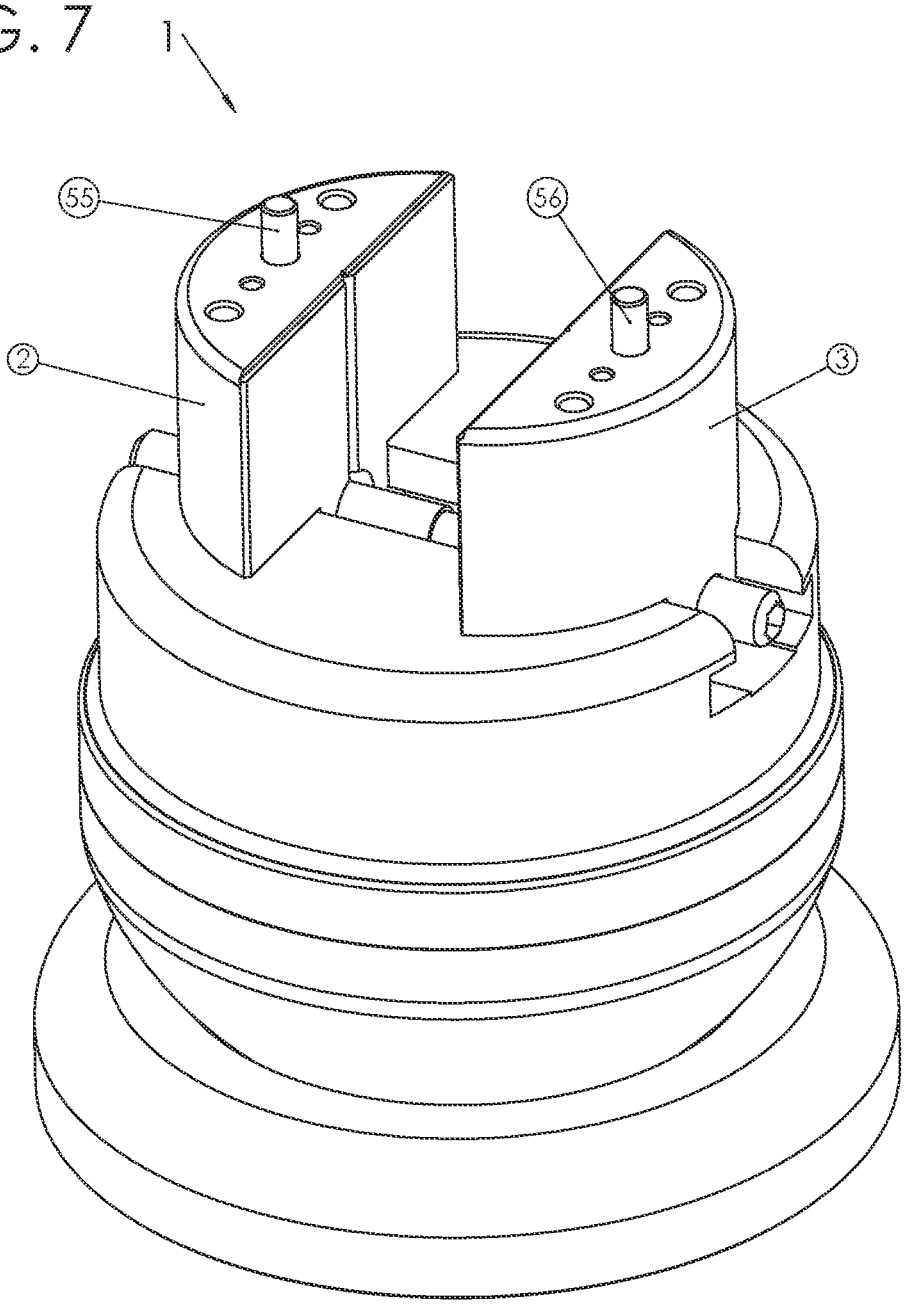
FIG. 7 is an isometric view of the same prior art ball vise 1 depicted in FIG. 1, but differing in that a dowel pin 55 have been inserted into hole 4 (FIG. 1) and that a dowel pin 56 has been inserted in hole 5 (FIG. 1).
Figure 8:
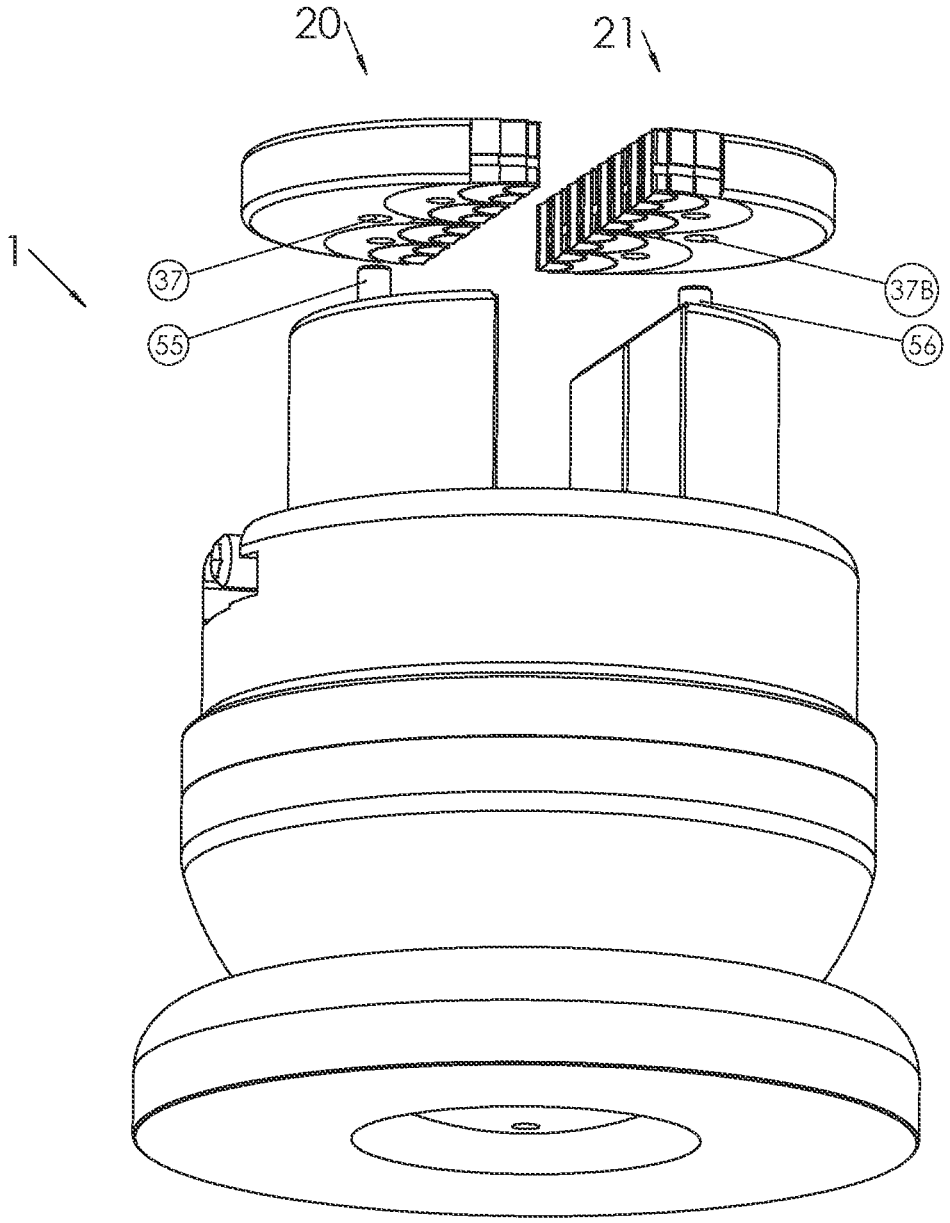
FIG. 8 is a lower view of the same prior art ball vise 1 depicted in FIG. 7 together with morphing jaws 20 and 21 depicted in FIG. 4 and FIG. 5.
Figure 9:
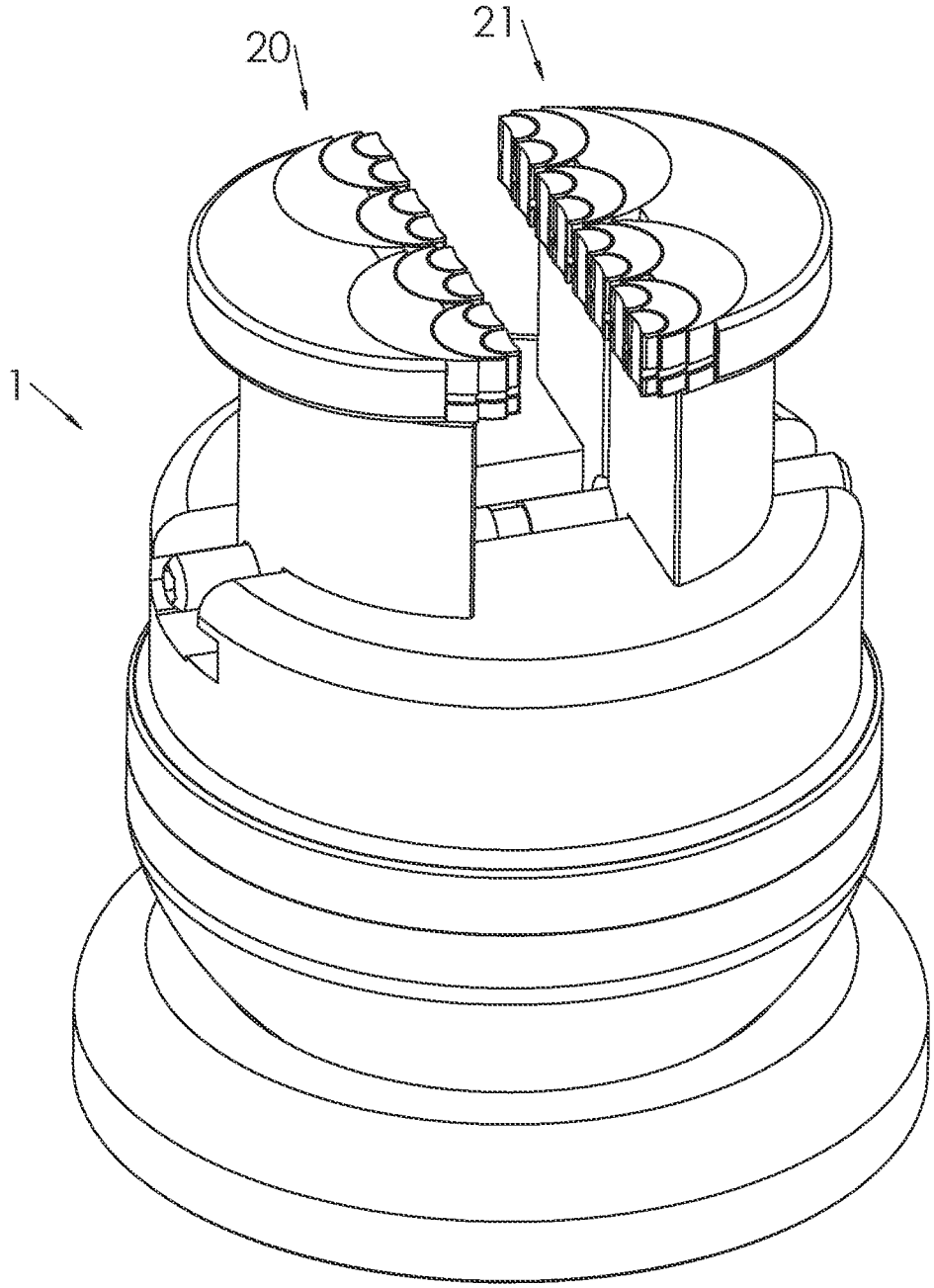
FIG. 9 is an isometric view depicting morphing jaws 20 and 21 after they have been installed on prior art ball vise 1, in accordance with the present invention.
Figure 10:
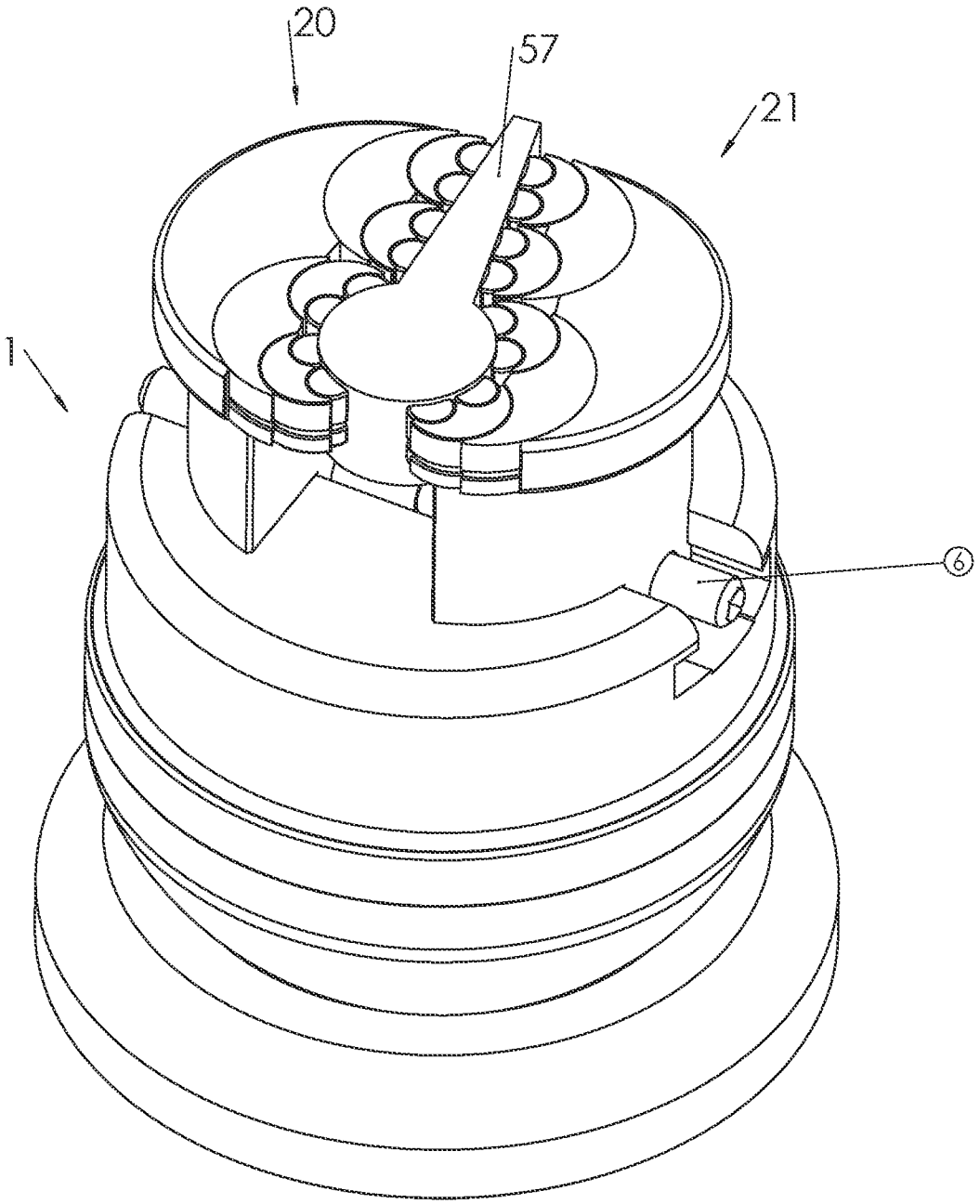
FIG. 10 is an isometric view depicting morphing jaws 20 and 21 after they have been installed on prior art ball vise 1, and an irregular shaped object 57 has been clamped in morphing jaws 20 and 21 showing how morphing jaws 20 and 21 will conform to the shape of the irregular shaped object 57, in accordance with the present invention.

In accordance with the present invention the process of installing and using morphing jaws 20 and 21 (FIG. 3, FIG. 2) on a prior art vise that the end user can carry out is: Referring to FIG. 7 illustrates a prior art ball vise 1. Dowel pin 55 and dowel pin 56 are installed into the existing jaws on prior art ball vise 1. Note: Most traditional prior art ball vises that engravers and jewelers use have for over a century pin holes on the top of their jaws for accepting dowel pins as depicted. Prior art vises that do not have this hole feature for a dowel pin in each jaw may be drilled and reamed to size to fit dowel pins. FIG. 8 illustrates morphing jaws 20 and 21 being aligned and installed. Dowel pin 55 is aligned with dowel pin hole 37 in morphing jaw 20 and dowel pin 56 is aligned with dowel pin hole 37B for morphing jaw 21. FIG. 9 depicts morphing jaws 20 and 21 installed on prior art ball vise 1 and ready for use. Morphing jaw 20 can pivot freely on dowel pin 55 and morphing jaw 21 can pivot freely on dowel pin 56. FIG. 10 illustrates how morphing jaws 20 and 21 will conform to the shape of the irregular shaped object 57 when the irregular shaped object 57 is held between morphing jaws 20 and 21 and screw 6 is closed to bias morphing jaws 20 and 21 together. When the user wishes to remove the irregular shaped object 57, the arrangement of the magnets if the two polarities are close enough will automatically pull the members to center. For members whose magnets are not close enough, the user can manually move a member until they are close enough for magnets to pull and center that member.

In accordance with the present invention the jaws can be disassembled easily by a user for cleaning. Simply pulling a member in the direction away from the concave-surface of another member allows the magnetism of the magnets to be overcome for the member to separate. The members sliding surfaces are wiped off and then reassembled.

Figure 11:
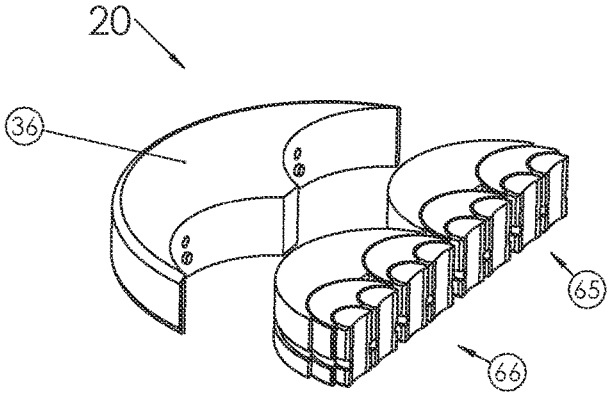
FIG. 11 is an isometric view of the morphing jaw 20 and how 4th-tier-bow-member 36 can be removed leaving sub-jaw 65 and sub-jaw 66 that can then be utilized by the user on smaller prior art vises, in accordance with the present invention.
Figure 12:
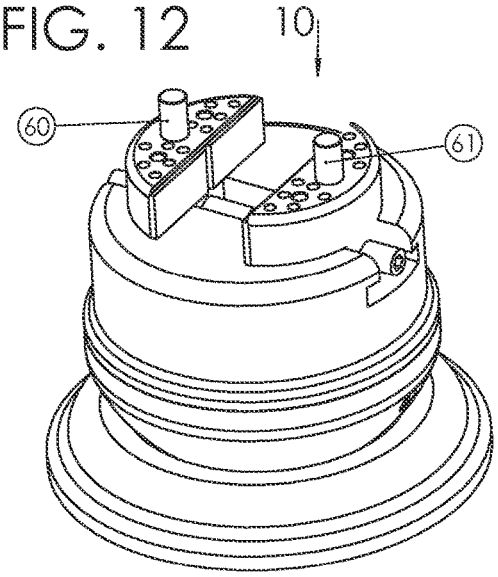
FIG. 12 is an isometric view of the same prior art ball vise 10 depicted in FIG. 2, but differing in that a dowel pin 60 has been inserted into hole 13 (FIG. 2) and that a dowel pin 61 has been inserted in hole 14 (FIG. 2).
Figure 13:
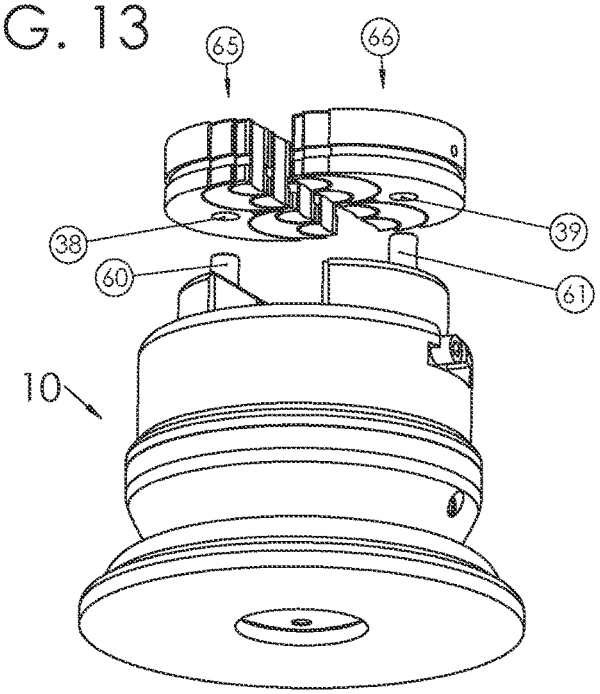
FIG. 13 is a lower isometric view of the same prior art ball vise 10 depicted in FIG. 12 together with sub-jaw 65 and sub-jaw 66 depicted in FIG. 11.
Figure 14:
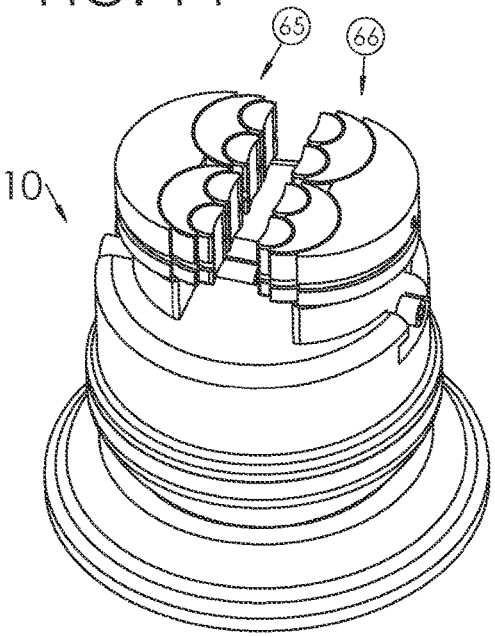
FIG. 14 is an isometric view depicting sub-jaw 65 and sub-jaw 66 depicted in FIG. 11 after they have been installed on prior smaller art ball vise 10, in accordance with the present invention.

In accordance with the present invention morphing jaws 20 and 21 can be utilized for use on smaller prior art vises. The process is as follows. FIG. 11 depicts morphing jaw 20 with 4th-tier-bow-member 36 pulled away leaving sub-jaw 65 and sub-jaw 66. FIG. 12 is a view of smaller prior art ball vise 10 with dowel pin 60 and dowel pin 61 installed into the existing jaws of smaller prior art ball vise 10. FIG. 13 illustrates sub-jaw 65 and sub-jaw 66 being aligned and installed on smaller prior art ball vise 10. Dowel pin 60 is aligned with dowel pin hole 38 in sub-jaw 65 and dowel pin 61 is aligned with dowel pin hole 39 for sub-jaw 66. Sub-jaw 65 can pivot freely on dowel pin 60 and sub-jaw 66 can pivot freely on dowel pin 61. FIG. 14 depicts morphing sub-jaw 65 and sub-jaw 66 installed on smaller prior art ball vise 10 and ready for use.

CONCLUSION, RAMIFICATIONS, AND SCOPE

Accordingly, the reader will see that the present invention provides users an opportunity to allow them to retro-fit their prior art vise to use morphing jaws that can conform to irregular shaped objects. The unique morphing jaws are modular so the user can utilize the jaws on other prior art vises and other prior vises that are smaller. The invention design allows ease of disassembly by users for cleaning and also reassembly. Since there is not a delicate dovetail used such as in U.S. Pat. No. 1,405,325 to Posch, the problems with members jamming or a piece of a dovetail breaking is eliminated. With the use of magnets in the invention to hold members together, another benefit is created and that is help to return members back to their neutral center position when an object is un-clamped. This means the user does not have as much of a job of having to center them himself or herself before clamping the next object.

Although the invention has been described with reference to the various embodiments, it should be noted that equivalents may be employed and substitutions made therein without departing from the scope of the invention as recited in the claims. For example: Applicant has illustrated ball vises for the prior art vises to place the morphing jaws on, however the invention jaws can be utilized on other type of prior art vises. Dowel pins are illustrated and used to pivot the last single tier of the jaw, however the last single tier can instead be rigidly mounted without departing from the present invention. The fewer tiers used the less shaping the jaw clamping members can adjust to conform, however even with a set of two tiers the method still provides benefits of working to conform without departing from the present invention. In other words, a two tier morphing jaw example is: clamping members 22 and 23 nested in 2nd-tier-bow-member 33. A dowel pin hole for attaching to a prior art vise would then be added to the bottom of 2nd-tier-bow-member 33 for it to pivot on. Another equivalent example is rather than the use of magnets, torsion springs could be used to return members back to their neutral position. Recesses for a torsion springs can be on the bottom of members. The middle of the torsion spring would be in one member while the legs of the torsion spring would reside in a recess on the fitting member of it so that the spring is at rest while the members are centered and are under tension when the members are not centered. Another equivalent is rather than the use of magnets to bias the members together, a wire spring arrangement could be employed between the members together with a slot or groove for the wire to hook into. Applicant has been a hand engraver for 46 years and has worked with many vise jaw designs. Therefore the field of the invention use for the applicant is hand engraving and jewelry making fields, however the invention can be utilized in other fields that also use a vise. Accordingly, the scope of the invention should be determined not by the embodiments illustrated, but by the appended claims and their legal equivalents.

I claim:

1. A morphing jaw for use with a vise, said morphing jaw comprising:

at least four first tier clamping members, said at least four first tier clamping members each comprising a front clamping surface and a rear radius surface;

at least two second tier bow members, said at least two second tier bow members each comprising a first concave surface, a second concave surface and a rear radius surface, said first concave surface and second concave surface of said at least two second tier bow members magnetically coupled to a corresponding said rear radius surface of at least one of said at least four first tier clamping members, the rear radius surfaces of the at least two second tier bow members including a circumferential groove and a magnet; and at least one third tier bow member, said at least one third tier bow member comprising a top surface, a bottom surface, a first concave surface, a second concave surface and a rear radius surface, said first concave surface and second concave surface of said at least one third tier bow member magnetically coupled to corresponding said rear radius surfaces of at least one of said at least two second tier bow members, the first concave surface and the second concave surface of the at least one third tier bow member each including a magnet and a pin for engagement with at least one of the circumferential grooves of the rear radius surfaces of the at least two second tier bow members.

2. A morphing jaw for use with a vise in accordance with claim 1, wherein said bottom surface of said at least one third tier bow member further comprises a dowel pin hole, wherein said dowel pin hole is configured for receiving a dowel pin for pivotal coupling with said vise.

3. A morphing jaw for use with a vise in accordance with claim 1, wherein each of said rear radius surfaces of said at least four first tier clamping members further comprises a circumferential groove and a magnet.

4. A morphing jaw for use with a vise in accordance with claim 3, wherein said first concave surface and said second concave surface of said at least two second tier bow members each further comprising a pin for engagement with at least one of said circumferential grooves of said rear radius surfaces of said at least four first tier clamping members.

5. A morphing jaw for use with a vise in accordance with claim 1, further comprising a fourth tier bow member comprising a top surface, a bottom surface, a first concave surface, a second concave surface and a rear radius surface, said first and second concave surfaces of said fourth tier bow member each having a magnet and a pin for engagement with a circumferential groove of said rear radius surface of said at least one third tier bow member.

6. A morphing jaw for use with a vise in accordance with claim 5, wherein said bottom surface of said fourth tier bow member further comprises a dowel pin hole, wherein said dowel pin hole is configured for receiving a dowel pin for pivotal coupling with said vise.

7. A morphing jaw for use with a vise in accordance with claim 1, wherein said rear radius surface of each of said at least four first tier clamping members, said at least two second tier bow members and said at least one third tier bow member further comprises a magnet such that a magnetic coupling is effectuated there between.

8. A morphing jaw for use with a vise, said morphing jaw comprising:

at least four first tier clamping members, said at least four first tier clamping members each comprising a front clamping surface and a rear radius surface, said rear radius surface further comprising a circumferential groove therein;

at least two second tier bow members, said at least two second tier bow members each comprising a first concave surface, a second concave surface and a rear radius surface, said first and second concave surfaces of said at least two second tier bow members each having a pin for engagement with at least one of said circumferential grooves of said rear radius of said at least four first tier clamping members, said rear radius surfaces of said at least two second tier bow members further comprising a circumferential groove therein;

at least one third tier bow member, said at least one third tier bow member comprising a top surface, a bottom surface, a first concave surface, a second concave surface and a rear radius surface, said first concave surface and second concave surfaces of said at least one third tier bow member each having a pin for engagement with at least one of said circumferential grooves of said rear radius of said at least two second tier bow members, said rear radius surface of said at least one third bow member further comprising a circumferential groove therein; and a fourth tier bow member comprising a top surface, a bottom surface, a first concave surface, a second concave surface and a rear radius surface, said first and second concave surfaces of said fourth tier bow member each having a magnet and a pin for engagement with the circumferential groove of said rear radius surface of said at least one third tier bow member.

9. A morphing jaw for use with a vise in accordance with claim 8, wherein said bottom surface of said at least one third tier bow member further comprises a dowel pin hole, wherein said dowel pin hole is configured for receiving a dowel pin for pivotal coupling with said vise.

10. A morphing jaw for use with a vise in accordance with claim 8, wherein said rear radius surface of each of said at least four first tier clamping members, said as least two second tier bow members and said at least one third tier bow member further comprise a magnet such that a magnetic coupling is effectuated there between.

11. A vise assembly with a pair of morphing jaws comprising:

a vise comprising a first and a second jaw; and a pair of morphing jaws, each one of said pair of morphing jaws further comprising:

at least four first tier clamping members, said at least four first tier clamping members each comprising a front clamping surface and a rear radius surface;

at least two second tier bow members, said at least two second tier bow members each comprising a first concave surface, a second concave surface and a rear radius surface, said first concave surface and second concave surface of said at least two second tier bow members magnetically coupled to a corresponding at least one of said rear radius surfaces of said at least four first tier clamping members, the rear radius surface of the at least two second tier bow members including a circumferential groove and a magnet; and at least one third tier bow member, said at least one third tier bow member comprising a top surface, a bottom surface, a first concave surface, a second concave surface and a rear radius surface, said first concave surface and second concave surface of said at least one third tier bow member magnetically coupled to corresponding at least one of said rear radius surfaces of said at least two second tier bow members, the first concave surface and the second concave surface of the at least one third bow member each including a magnet and a protrusion, the protrusion configured to engage with the circumferential grooves of the rear radius surfaces of the at least two second tier bow members;

wherein one of each said pair of morphing jaws is pivotally coupled to one of said first and second jaws of said vise such that said morphing jaws move with said first and second jaws of said vise.

12. A vise assembly in accordance with claim 11, wherein said bottom surface of said at least one third tier bow member further comprises a dowel pin hole, wherein said dowel pin hole is configured for receiving a dowel pin for pivotal coupling with said vise.

13. A vise assembly in accordance with claim 11, wherein said rear radius surface of said at least four first tier clamping members further comprises a circumferential groove and magnet.

14. A vise assembly in accordance with claim 13, wherein said first concave surface and said second concave surface each further comprises a pin for engagement with said circumferential grooves of said rear radius surfaces of said at least four first tier clamping members.

15. A vise assembly in accordance with claim 11, further comprising a fourth tier bow member comprising a top surface, a bottom surface, a first concave surface, a second concave surface and a rear radius surface, said first and second concave surfaces of said fourth tier bow member each having a magnet and a pin for engagement with a circumferential groove of said rear radius surface of said at least one third tier bow member.

16. A vise assembly in accordance with claim 15, wherein said bottom surface of said fourth tier bow member further comprises a dowel pin hole, wherein said dowel pin hole is configured for receiving a dowel pin for pivotal coupling with said vise.

17. A vise assembly in accordance with claim 11, wherein said rear radius surface of each of said at least four first tier clamping members, said as least two second tier bow members and said at least one third tier bow member further comprise a magnet such that a magnetic coupling is effectuated there between.

18. A vise assembly in accordance with claim 11, wherein the protrusion is a pin.

* * * * *